US010393395B1

(12) United States Patent
Gardner

(10) Patent No.: US 10,393,395 B1
(45) Date of Patent: Aug. 27, 2019

(54) ICE MELTING LOUVER

(71) Applicant: Amazon Technologies, Inc., Seattle, WA (US)

(72) Inventor: Brock Robert Gardner, Seattle, WA (US)

(73) Assignee: Aamzon Technologies, Inc., Seattle, WA (US)

( * ) Notice: Subject to any disclaimer, the term of this patent is extended or adjusted under 35 U.S.C. 154(b) by 1057 days.

(21) Appl. No.: 14/706,445

(22) Filed: May 7, 2015

(51) Int. Cl.

| | |
|---|---|
| ***F24F 11/00*** | (2018.01) |
| ***F24F 13/14*** | (2006.01) |
| ***F24F 11/30*** | (2018.01) |
| *F24F 11/42* | (2018.01) |

(52) U.S. Cl.
CPC ..... *F24F 11/30* (2018.01); *F24F 11/0001* (2013.01); *F24F 13/14* (2013.01); *F24F 11/42* (2018.01)

(58) Field of Classification Search
CPC .... F24F 11/41; F24F 3/14; F24F 13/14; F24F 7/007; F24F 2013/1473; G05D 23/08; F23L 13/00
USPC ..... 62/151
See application file for complete search history.

(56) References Cited

U.S. PATENT DOCUMENTS

| | | | | |
|---|---|---|---|---|
| 2,153,359 | A * | 4/1939 | Anderson | B61C 1/12 454/103 |
| 3,766,812 | A * | 10/1973 | McEwen | B23B 31/4073 269/49 |
| 5,319,854 | A * | 6/1994 | Pracht | B26B 13/28 30/194 |
| 7,031,154 | B2 * | 4/2006 | Bash | H05K 7/20718 165/80.3 |
| 2011/0003542 | A1 | 1/2011 | Halland | |
| 2012/0168145 | A1 * | 7/2012 | Peterson | H05K 7/20745 165/287 |

FOREIGN PATENT DOCUMENTS

| | | | | |
|---|---|---|---|---|
| FR | 2274823 | A1 * | 1/1976 | E05D 3/02 |
| FR | 2274823 | A1 * | 1/1976 | E05D 3/02 |
| GB | 2349454 | A * | 11/2000 | A47F 3/001 |
| GB | 2349454 | A * | 11/2000 | A47F 3/001 |
| JP | 2010281522 | A * | 12/2010 | |
| JP | 2010281522 | A * | 12/2010 | |

* cited by examiner

*Primary Examiner* — Jianying C Atkisson
*Assistant Examiner* — Meraj A Shaikh
(74) *Attorney, Agent, or Firm* — Kilpatrick Townsend & Stockton LLP

(57) ABSTRACT

A louver assembly includes a heating element configured to provide heat to at least one edge of at least one blade of the louver assembly to prevent or eliminate ice build-up along the edge of the blade. Variations include fixed blades, rotatable blades, power supply lines routed through pivot points or mechanical linkages for moving blades, and different forms of heating elements such as wires that produce heat due to electrical resistance or infrared heating panels.

20 Claims, 6 Drawing Sheets

117

100
108a
114a
120a
115
105a
111a
104a
102
118a
112a
108b
106a
116
113a
104b
122
110
105b
108c
106b
104c
105c
106c
124
126
128

ICE MELTING LOUVER

BACKGROUND

Most buildings utilize heating, ventilation, and air conditioning (HVAC) systems to provide heating or cooling to spaces within the building. For example, many commercial buildings use HVAC systems to regulate air temperature and/or humidity so that spaces within the building will be comfortable for people working, playing, or otherwise spending time in those spaces. Some HVAC systems are designed to provide specific amounts of heating and/or cooling to equipment housed in the building. For example, HVAC systems may be used to provide cooling to computer servers and associated components housed in a datacenter or comparable facility. Such HVAC systems are typically operated so as to provide air to equipment at a temperature that is suitable for providing sufficient heat transfer between the air and the equipment to maintain the equipment within a target temperature range, regardless of the temperature of the environment outside of the building.

Generally, HVAC systems have intake and/or exhaust vents for respectively communicating air from or into the environment. For example, HVAC systems usually pull air from the environment through an intake vent and pass that air into a room (often after suitably conditioning the air such as by changing levels of heat, moisture, and/or pressure) so that heat is transferred into the air (i.e., to cool things in the room) or out of the air (i.e., to heat things in the room). Air that has undergone such heat transfer is often passed out of the room and released into the environment through an exhaust vent. The volumes of air permitted to pass through intake and/or exhaust vents accordingly can affect amounts of heating or cooling that HVAC systems can provide. As such, unintended obstruction of intake and/or exhaust vents can impair heating or cooling capacity of HVAC systems. Impaired HVAC systems may lead to unacceptable temperature and/or climate conditions within the building, which may result in harm to people or equipment in the building and/or costly suspension of normal operations to avoid such harm. For example, unintended obstruction of intake and/or exhaust vents in a datacenter could cause servers to shut down to avoid overheating, thereby negatively affecting availability of the datacenter and causing undesirable service interruptions.

BRIEF DESCRIPTION OF THE DRAWINGS

Various embodiments in accordance with the present disclosure will be described with reference to the drawings, in which.

DETAILED DESCRIPTION

In the following description, various embodiments will be described. For purposes of explanation, specific configurations and details are set forth in order to provide a thorough understanding of the embodiments. However, it will also be apparent to one skilled in the art that the embodiments may be practiced without the specific details. Furthermore, well-known features may be omitted or simplified in order not to obscure the embodiment being described.

Embodiments herein are directed to HVAC systems having louver assemblies with heated blades. Providing heat to the blades (e.g., along an edge of the blade) can eliminate or prevent accumulation of ice on the edge of the blade, such as during sub-freezing weather. In the absence of such heating, ice may accumulate as a result of freezing fog, sub-freezing temperatures acting on moisture in air exhausted from the HVAC system, or other combinations of weather conditions and air characteristics. Ice accumulation can obstruct air flow between the louver blades and/or prevent the blades from moving among different orientations (such as shifting between open and shut positions). Such impairment of the normal operation of the louver blades can affect control of air volumes utilized by an HVAC system, which may lead to damage or shut-down of components in a building such as a datacenter. As such, louver assemblies with heated blades may reduce risks of such impairment and accordingly increase availability of datacenters.

Figure 1:
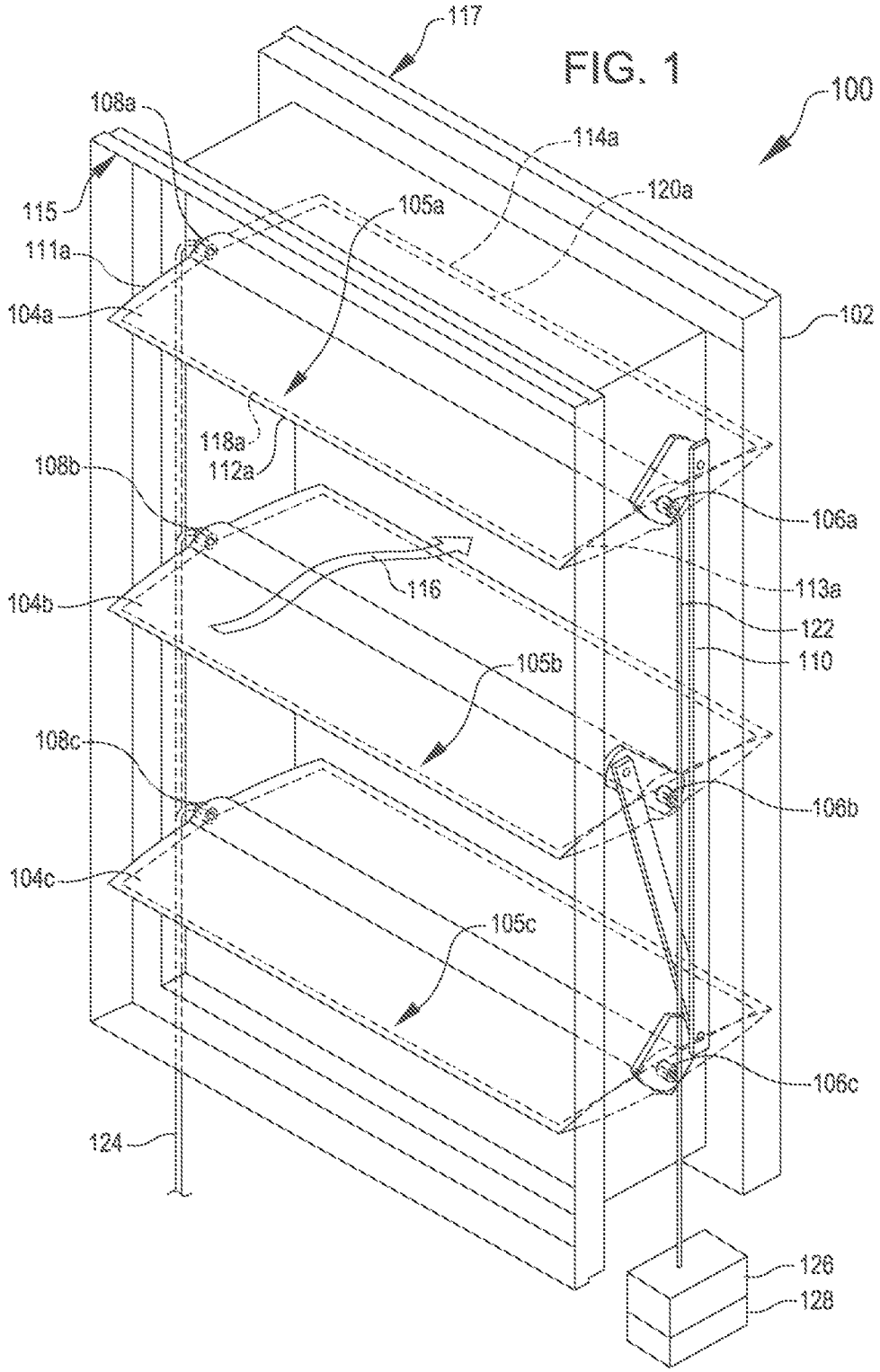
FIG. 1 illustrates a perspective view of a louver assembly with heated blade edges according to certain embodiments.

Referring now to the drawings, in which like reference numerals may refer to like elements, FIG. 1 illustrates one example of a louver assembly 100 according to certain embodiments. The louver assembly 100 includes a frame 102 that supports blades 104 (individually identified as 104*a*, 104*b*, etc.). Any number of blades 104 can be used (including one or more than one), and in the embodiment shown in FIG. 1, a top blade 104*a*, a middle blade 104*b*, and a bottom blade 104*c* are provided. Each of the blades 101 illustrated in FIG. 1 has similar features, and, while the following description primarily describes the top blade 104*a*, it may be appreciated that the other blades 104*b* and 104*c* can have corresponding features and functions to those described with respect to the top blade 104*a*.

The blade 104*a* is coupled with the frame 102 via a first pivot 106*a* and a second pivot 108*a* (respectively, at a right side and a left side of FIG. 1). The blade 104*a* is coupled with a linkage 110 such that movement of the linkage 110 causes the blade 104*a* to rotate relative to the first pivot 106*a* and the second pivot 108*a*.

The blade 104*a* shown in FIG. 1 has an airfoil shape, but any other shape can be used, for example, to alter airflow characteristics over the blade 104. The illustrated blade 104*a* has a first transverse edge 111*a* (e.g., on left end in FIG. 1), a leading edge 112*a* (e.g., on a front end in FIG. 1), a second transverse edge 113*a* (e.g., on a right end in FIG. 1), and a trailing edge 114*a* (e.g., on a rear end in FIG. 1). The leading edge 112*a* and the trailing edge 114*a* make up the long edges of the blade 104*a*, running along the length of the blade 104*a* (e.g., between the transverse edges 111*a*). The transverse edges 111*a* and 113*b* make up the short ends of the blade 104*a*. In general, when the blade 104*a* is installed in the frame 102, the leading edge 112*a* and the trailing edge 114 extend substantially parallel to an axis of rotation about which the blade 104 rotates relative to the pivots 106*a* and 108*a*. The transverse edges 111*a* and 113*a* generally face the sides of the frame 102 between the front 115 and the rear 117 of the frame.

When the louver assembly 100 is in the open position (e.g., as shown in FIG. 1), the leading edge 112 faces out of the front 115 of the frame 102, and the trailing edge 114*a* faces out of the rear 117 of the frame 102. Also, in the open position shown in 1, the transverse edges 111*a* and 113*a* extend from the front 115 to the rear 117, e.g., substantially parallel to the top and bottom of the of the frame 102.

The front 115 of the louver assembly 100 corresponds to a side of the louver assembly 100 that is closest to or exposed to the environment outside of the building. For example, when the louver assembly 100 is installed in an intake vent of a HVAC system, air flows into the building through the frame 102 in a direction from the front 115 of the frame 102 to the rear 117 of the frame 102, e.g., as illustrated by the arrow 116. However, the louver assembly 100 illustrated in FIG. 1 may correspond to either an intake vent or an exhaust vent. Thus, in contrast, when the louver assembly 100 is installed in an exhaust vent of a HVAC system, air flows out of the building through the frame 102 in a direction from the rear 117 of the frame 102 to the front 115 of the frame 102, e.g., opposite to the direction illustrated by the arrow 116. In either case, the transverse edges 111*a* and 113*a* are positioned substantially parallel to the direction of the airflow (e.g., substantially parallel to the arrow 116) when the louver assembly 100 is in the open position shown in FIG. 1.

The blade 104*a* includes a heating element 105. The heating element 105 can be any heating mechanism or device that provides heat (e.g., conductive and/or radiant heat) to a blade of the louver assembly. For example, in FIG. 1, the heating element 105 includes a first wire 118*a* arranged along the leading edge 112*a* and a second wire 120*a* arranged along the trailing edge 114*a*. Each of the wires 118*a* and 120*a* may also be arranged at least partially along either or both of the transverse edges 111*a* or 113*a* as shown in FIG. 1. In the embodiment shown in FIG. 1, the wires 118*a* and 120*a* are coupled with supply lines 122 and 124. In operation, electrical power is provided via the supply line 122, flows in parallel through wires 118*a* and 120*a*, and flows out through supply line 124. The wires 118*a* and 120*a* are constructed of a material with sufficient electrical resistance to provide heat when the electrical power is conveyed through the wire 118 or 120.

The heating element 105*a* can heat the leading edge 112*a* and/or the trailing edge 114*a* a sufficient amount to prevent or eliminate ice formation along the leading edge 112*a* and/or the trailing edge 114*a*. In the absence of the heating element 105*a*, ice hanging from the top blade 104*a* may obstruct airflow between the top blade 104*a* and the middle blade 104*b* when the louver assembly 100 is in the open arrangement illustrated in FIG. 1.

In some embodiments, one or the other of the wires 118*a* and 120*a* may be omitted. For example, in some scenarios, ice formation may be anticipated only along one long edge of the blade 104*a* (e.g., along the long edge of the blade 104*a* facing the exterior of the building), and the heating element 105*a* may be arranged to only provide heat along that long edge of the blade 104*a*. However, even if ice formation is only anticipated along one long edge, arranging the heating element 105*a* to provide heat to both the leading edge 112*a* and the trailing edge 114*a* can allow the blade 104*a* to be reversible during installation (e.g., ensuring that the heating element 105*a* will heat the long edge at highest risk of ice formation, regardless of whether the leading edge 112*a* is installed facing the front 115 or the rear 117 of the frame 102).

Additionally, although FIG. 1 illustrates a single supply line 122 with parallel feeds into each of the pivots 106*a*, 106*b*, and 106*c*, individual supply lines 122 to each individual blade 104 can be provided instead. For example, such an arrangement may permit individual blades 104 to be heated by different amounts or heated independently of one another, such as to provide redundancy against overall failure of heating due to a defect in a single supply line 122 or 124.

A transformer 126 coupled with the supply line 122 can alter a voltage level of the power flowing through the supply line 122 and into the wires 118*a* and 120*a*. Altering the voltage can alter the amount of heat produced in response to the resistance in the wires 118*a* and 120*a*. Additionally or alternatively, a switch 128 coupled with the supply line 122 can control the flow of electricity through the supply line 122, allowing the edges 112 and 114 of the blade 104 to be selectively heated or not heated.

Figure 2:
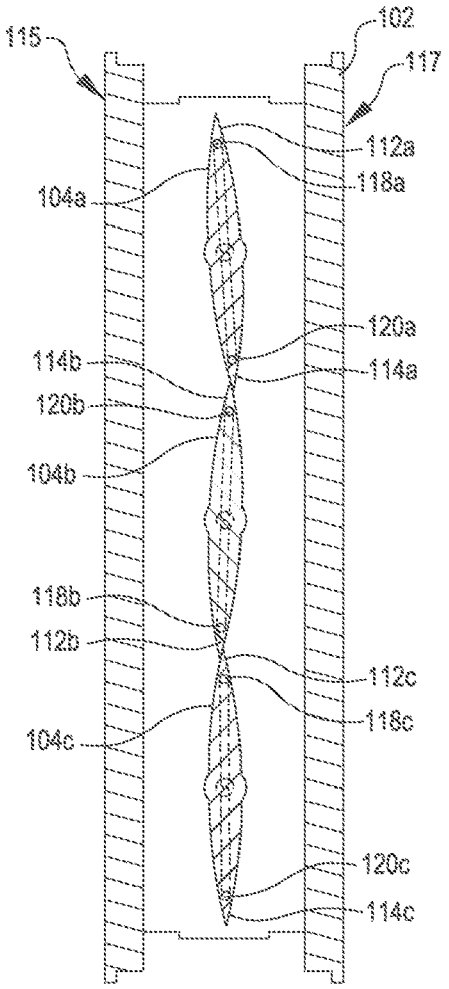
FIG. 2 illustrates a side section view of the louver assembly of FIG. 1 in a closed configuration according to certain embodiments.

FIG. 2 illustrates a side view of the louver assembly 100 in a closed arrangement. The individual blades 104*a*, 104*b*, and 104*c* can be moved between an open configuration (e.g., shown in FIG. 1, in which the blades 104 are oriented substantially parallel to the airflow illustrated by arrow 116) and a closed position (e.g., shown in FIG. 2, in Which the blades 104 are positioned substantially perpendicularly to and obstructing the airflow illustrated by the arrow 116 of FIG. 1). For example, the illustrated louver assembly 100 can be switched from the closed arrangement of FIG. 2 to the open arrangement of FIG. 1 by rotating the top blade 104*a* in a counterclockwise direction with respect to FIG. 2, by the middle blade 104*b* in a clockwise direction with respect to FIG. 2, and by rotating the bottom blade 104*c* in the counterclockwise direction with respect to FIG. 2.

The wires 120 and 118 in the blades 104 can prevent the blades 104 from freezing in a closed position shown in FIG. 2. For example, the wires 120*a* and 120*b* shown in FIG. 2 can provide sufficient heat to prevent or eliminate any ice build-up between the respective edges 114*a* and 114*b* of the first blade 104*a* and the second blade 104*b* that are proximate one another in the closed arrangement.

As discussed above, the blades 101 can include wires 118 and 120 on both long edges of the blades 104 so as to make the blades 104 reversible during installation. However, embodiments in which only one long edge of a blade 104 is equipped with a heating element 105 are also within the scope of the present disclosure. For example, in some embodiments, the edges 114*a* and 114*b* can be prevented from freezing together into the closed position of FIG. 2 by just the heat from wire 120*a* or 120*b*, such that one or the other of wires 120*a* or 120*b* can be omitted.

Figure 3:
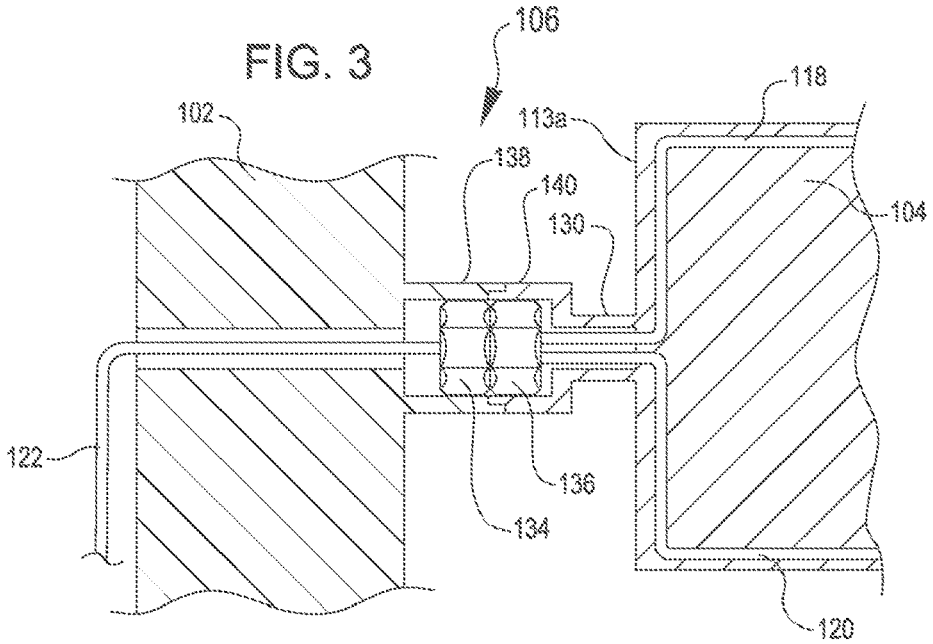
FIG. 3 illustrates one example of a pivot joint for the louver assembly of FIGS. 1 and 2 according to certain embodiments.

Electrical power can be supplied to a heating element 105 on a blade 104 by any suitable mechanism. In some embodiments, electrical power is supplied through a pivot 106 and/or pivot 108. For example, FIG. 3 illustrates an example of a pivot 106 according to certain embodiments. The blade 104 has an arm 130 extending from the short transverse edge 113*a* of the blade 104. The arm 130 couples with the frame 102 so that the blade 104 is able to pivot relative to the frame 102. The arm 130 includes a conductive nut 136 coupled with the wires 118 and 120. A supply line 122 is routed through the frame 102 to a second conductive nut 134. The two conductive nuts 134 and 136 are aligned and coupled together with sufficient proximity for electrical connection to occur between the two nuts 134, 136. The nuts 134 and 136 are rotatable relative to one another while still maintaining an electrical connection for providing power through the supply line 122 to the wires 120 and 118.

In the embodiment shown in FIG. 3, the pivot 106 also includes a set of complementary casings 138 and 140. The first casing 138 forms part of the frame 102, and the second casing 140 forms part of the blade 104. The casing portions 138 and 140 matingly couple to surround the nuts 134 and 136. The casing portions 138 and 140 can maintain the nuts 134 and 136 sufficiently close for the electrical connection. Additionally or alternatively, the casing portions 138 and 140 can insulate the nuts 134, 136 to reduce an exposure of a live electrical connection at the joint between the frame 102 and the blade 104 (e.g., to improve the safety of the pivot 106). As may be appreciated, the pivot 108 can also include a similar construction for providing an electrical connection to the supply line 124 through which the electrical current exits the frame 102.

Figure 4:
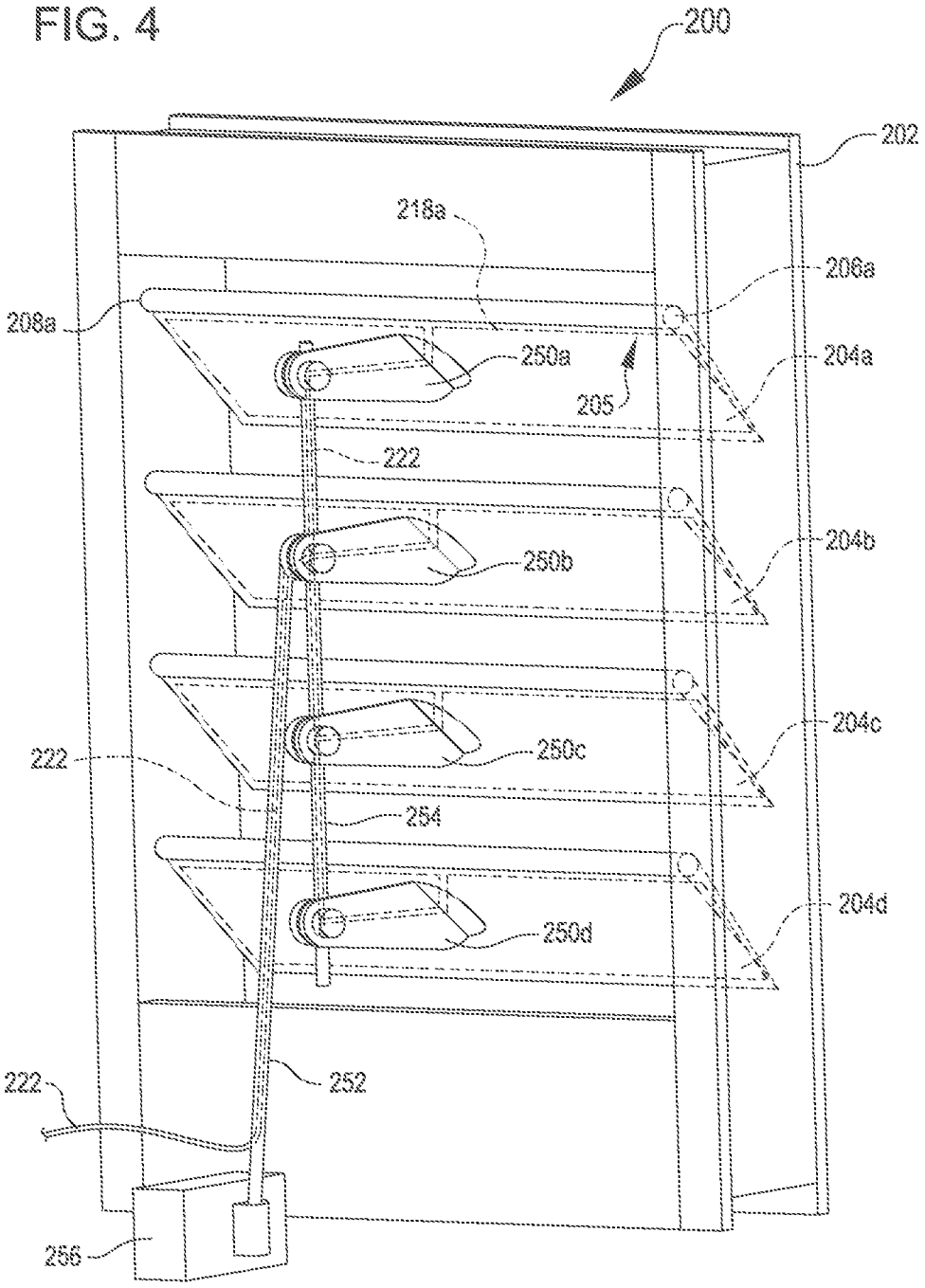
FIG. 4 illustrates a perspective view of another louver assembly having heated blade edges according to certain embodiments.

FIG. 4 illustrates another louver assembly 200 according to certain embodiments. The blades 204 (individually identified as 204*a*, 204*b*, etc. in FIG. 4) are pivotally coupled with the frame 202 via pivots 206 and 208. Each blade 204 has a corresponding arm 250. A connecting rod 254 connects the individual arms 250 for synchronized movement of the blades 204. A linkage 252 is coupled with the connecting rod 254. The linkage 252 is movable by an actuator 256 in order to adjust the angle of the louver blades 204.

A supply line 222 is routed along the linkage 252 and connecting rod 254 to supply electrical power to each blade 204. Each blade 204 includes a wire 218 arranged at least along one long edge of the blade 204. For example, in the arrangement illustrated in FIG. 4, each blade 204 is illustrated with a wire 218 arranged around the perimeter of the blade 204. In operation, current flows into the wire 218 from the supply line 222, through the wire 218 arranged around a perimeter of the blade 204, and back into the supply line 222. In this manner, the supply line 222 may include internal wiring to separately accommodate the electrical current flowing in and the electrical current flowing out.

As may be appreciated, the supply line 222 is routed separately from the actuator 256 in the embodiment shown in FIG. 4. Such an arrangement may prevent electrical power from being conducted into the actuator 256 and damaging the actuator 256. Other methods of protecting the actuator 256 are also possible, including, but riot limited to, using an insulated wire for the supply line 222, using a linkage 252 made of a non-conductive material, or other options.

Additionally, although FIG. 4 illustrates electrical current being routed in and out of the same supply line 222, other arrangements are also possible. For example, electrical current may be provided to a heating element 205 on the blade 204*a* through a supply line routed along a linkage 252 and/or connecting rod 254 and the electrical power may be routed out of the blade 204*a* through a pivot point 206*a* or 208*a*. As may thus be appreciated, wiring could be routed in any desired manner through any combination of entry or exit points to provide power to heating elements 205 of the blades 204, such as routing wiring through the frame 202 (e.g., through pivots 206, 208 of other blades 204) and/or through the connecting rod 254 (e.g., through any subsequent arms 250 of other blades 204).

Heating elements may be provided for louver blades in any suitable manner. For example, with reference to FIGS. 1-3, heating element wires 118, 120 can be integrally formed into the blades 104 and/or frame 102 during construction of the louver assembly 100. As an example, a blade 104 may have edges folded over the wires 118, 120 to secure the wires 118, 120 in place within the blade 104. In other embodiments, the entire blade 104 may be the heating element 105. For example, the blade 104 may be constructed of material with sufficient electrical resistance that the whole blade 104 produces heat in response to electrical power communicated to the blade 104.

Figure 5:
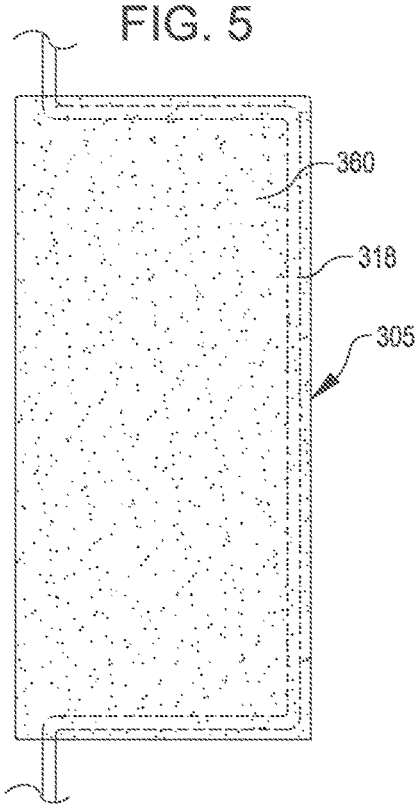
FIG. 5 illustrates an example of a substrate for retrofitting a louver assembly with a heating element according to certain embodiments.

In some embodiments, heating elements can be added to louver assemblies that are already existing and/or installed. For example, FIG. 5 illustrates a substrate 360 for retrofitting a louver assembly 300 according to certain embodiments. The substrate 360 may be of any suitable material and may have a heating element 305 (in FIG. 5, a wire 318) integrated into or attached to the substrate 360 in any suitable manner. For example, in the embodiment shown in FIG. 5, the wire 318 is positioned within layers of the substrate 360. In alternate embodiments, the substrate 360 may include adhesive material and a wire 318 can be arranged along the substrate 360 and attached by the adhesive qualities. In further alternate embodiments, the substrate 360 may be an electrically conductive surface with sufficient resistance that that the whole substrate produces heat in response to receiving electrical power.

Figure 6:
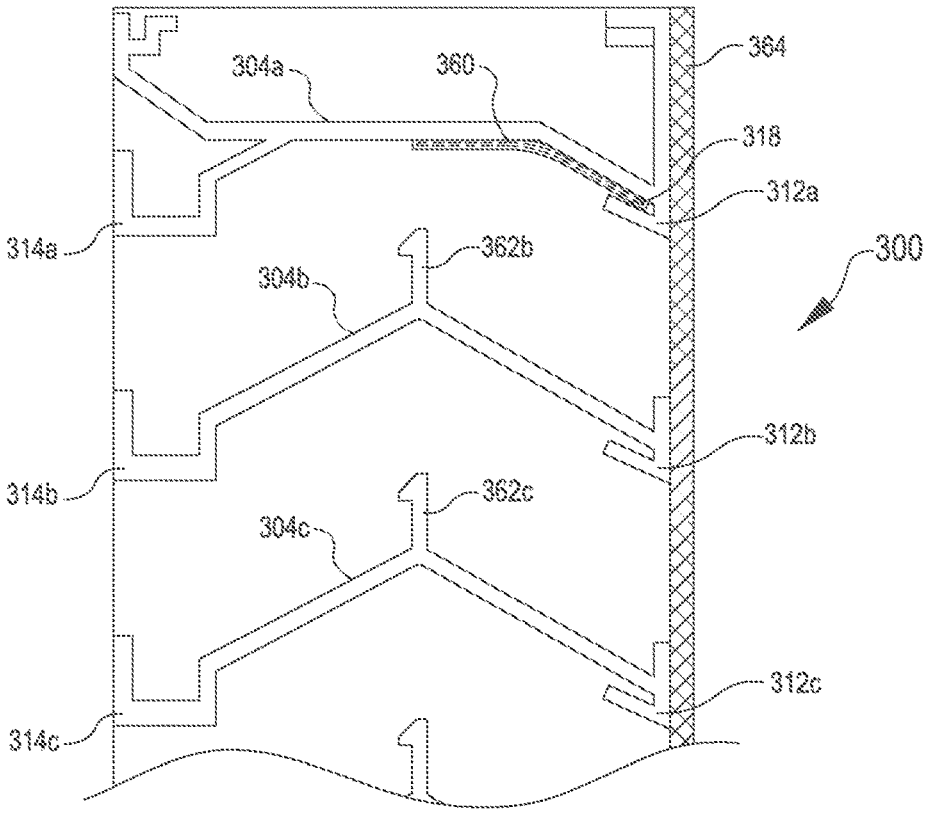
FIG. 6 illustrates a side cross-sectional view of an example of a fixed louver assembly with the heating element of FIG. 5 installed according to certain embodiments.

FIG. 6 illustrates a side view of an example of a fixed louver assembly 300. The fixed louver assembly 300 has blades 304 that are fixed, in contrast to the blades 104 or 204 that are movable in FIGS. 1-4. As illustrated in FIG. 6, a substrate 360 from FIG. 5 can be attached to a blade 304 to retrofit the louver assembly 300 with a heating element 305. For example, the wire 318 can be installed via the substrate 360 so as to provide heat to a leading edge 312*a* of a blade 304*a* for preventing or eliminating ice build-up at the leading edge 312*a*. The substrate 360 can be attached to the blade 304*a* by any suitable mechanism, including, but not limited to adhesives, welding, or mechanical fastening structures.

The blades 304 may include other features (such as projections 362 or a bird screen 364) that may prevent passage of unwanted objects through the louver assembly 300 while still allowing air passage. Although the substrate 360 is shown in FIG, 6 at a leading edge 312 of the blade 304*a*, the substrate 360 and/or heating element 305 may be utilized on any feature of the louver assembly 300, including, but not limited to other features, such as the projections 362 or the bird screen 364.

Figure 7:
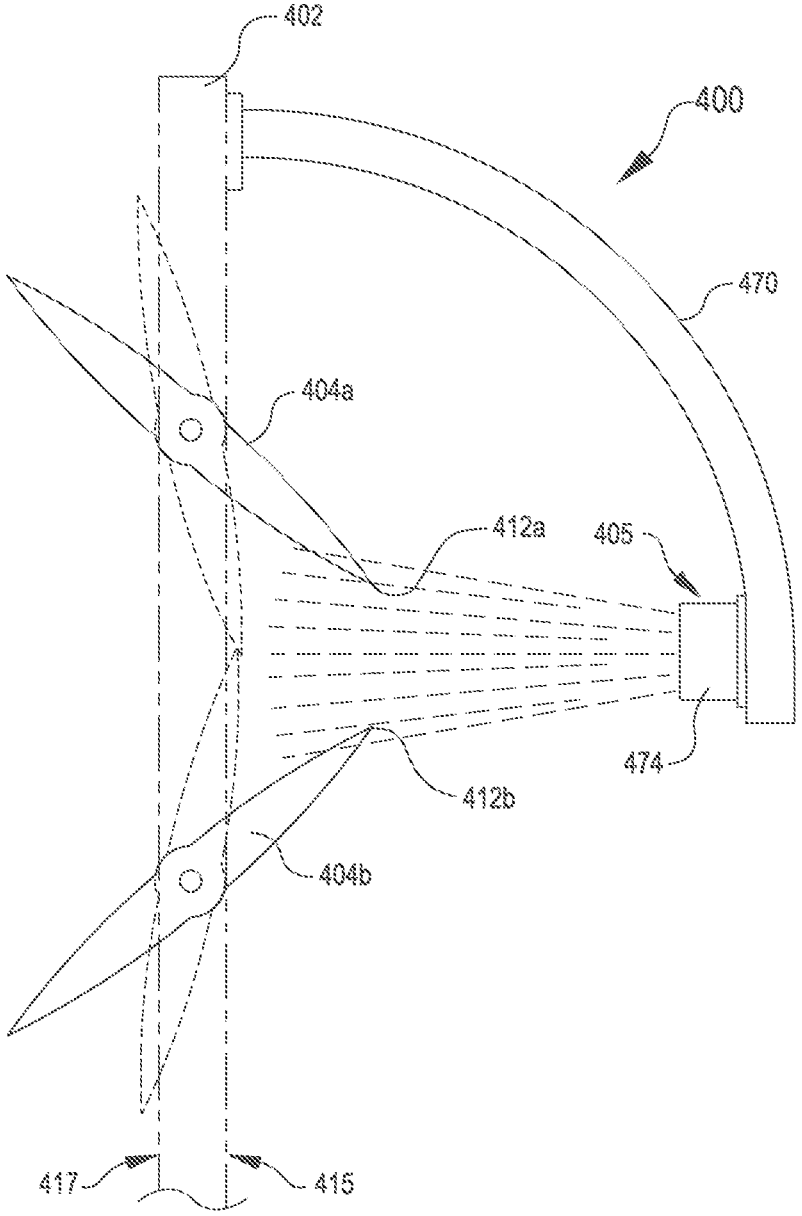
FIG. 7 illustrates a side view of an example of a louver assembly with blade edges heated by an infrared heating element positioned on a hood of the assembly according to certain embodiments.

FIG. 7 illustrates another example of a louver assembly 400. A hood 470 extends from a front 415 of the frame 402 of the louver assembly 400. A heating element 405 is positioned on the hood 470. In the embodiment shown in FIG. 7, the heating element 405 is an infrared heater panel 474. The infrared heater panel 474 can generate infrared electromagnetic waves that can be used to heat objects. The infrared heater panel 474 can be oriented so as to radiate heat towards edges 412*a* and 412*b* of louver blades 404*a* or 404*b* to prevent or eliminate ice build-up. Furthermore, although the infrared heater panel 474 is illustrated on the hood 470, other arrangements are also possible, including arrangements in which the infrared heater panel 474 is arranged on one of the blades 404. For example, the infrared heater may be aimed to provide heat to the blade 404 to which it is fixed and/or heat to another blade 404 in the louver assembly 400.

Figure 8:
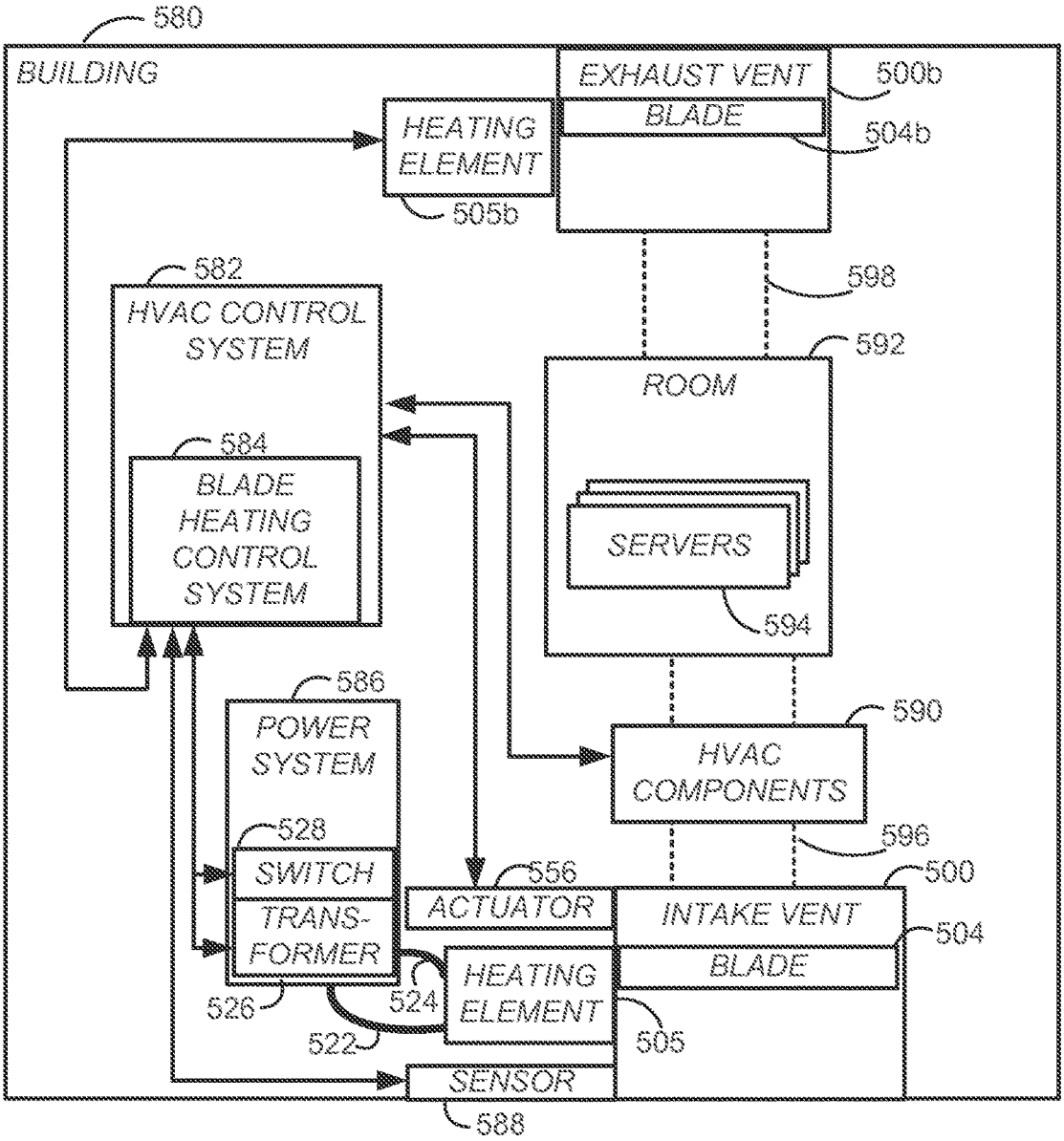
FIG. 8 illustrates a schematic view of an example of a building with heated louver blades according to certain embodiments.

FIG. 8 illustrates a schematic view of an example of a building 580 with heated louver blades 504 and 504*b* according to certain embodiments. In the illustrated embodiment, a blade heating control system 584 communicates with and/or controls various elements to control heating of a blade 504 positioned in an intake vent 500. For example, the blade heating control system 584 can receive information from a sensor 588 and control the heat provided to the blade 504 based on the received sensor information. The sensor 588 can include any suitable sensor or combination of sensors for gathering information such as outside air temperature, the humidity level of air being passed through the vent 500, resistance to movement of the louver blade 504, and/or any other indicator of the presence of conditions associated with a risk, likelihood, or presence of ice accumulation on the louver blade 504. Although the sensor 588 is depicted in FIG. 8 near the intake vent 500, the sensor 588 may be positioned at any appropriate location for gathering relevant information, including, but not limited to, inside the building 580, on an exterior of the building 580, or at a location remote from the building 580.

In the illustrated embodiment of FIG. 8, the blade heating control system 584 controls heating of the blade 504 by communicating with and/or controling elements of a power system 586. In a first example, the blade heating control system 584 can communicate with a transformer 526 (e.g., the transformer 126 of FIG. 1) to modify a voltage or power level conveyed to a heating element 505 via supply line 522 and/or supply line 524. This modified voltage or power level can result in an increase or decrease in an amount of heat provided to the blade 504. Such functionality may be useful in situations in which weather conditions outside of the building 580 fluctuate with respect to severity. For example, in more severe conditions, the transformer 526 can be controlled to provide a greater amount of heat for melting or preventing ice on the blade 504.

As another example, a switch 528 (e.g., the switch 128 of FIG. 1) can also be in communication with and/or under control of the blade heating control system 584 so that heating operation can be activated or deactivated as desired, such as to conserve energy when heating is not warranted by weather conditions (e.g., when humidity and temperature are unlikely to result in ice production). For example, the blade heating control system 584 may be configured to activate the heating element 505 in response to an indication (e.g., from data from the sensor 588) of a presence of conditions associated with a risk, likelihood, or presence of ice accumulation on the louver blade 504.

The blade heating control system 584 may be an independent control system or may be in communication with—or part of—a HVAC control system 582 of the building 580 (e.g., as shown in FIG. 8). In the illustrated embodiment, the HVAC control system 582 communicates with and/or controls elements to provide a room 592 of the building 580 with air of a certain quality (e.g., satisfying criteria related to temperature, humidity, and/or pressure). As an illustrative example, during operation, the HVAC control system 582 controls operation of an actuator 556 (e.g., the actuator 256 of FIG. 4) to adjust the orientation of the blade 504 of the intake vent 500 and alter an air volume conveyed through the intake vent 500 and corresponding ducting 596 to other HVAC components 590. The other HVAC components 590 (such as compressors, blowers, heat exchangers, etc.) are controlled to change the condition (e.g., levels of heat, moisture, and/or pressure) of the air that is provided to the room 592 and/or equipment in the room 592, such as to computer servers 594 of a datacenter, The HVAC control system 582 also controls components to transfer exhaust air out of the room 592 through ducting 598 and an exhaust vent 500*b* into the environment outside of the building 580. The exhaust vent 500*b* is shown in FIG. 8 with a heating element 505*b* in direct communication with the same blade heating control system 584 that controls the heating of the blade 504 of the intake vent 500. However, the heating element 505*b* may be controlled by a distinct control system and/or with similar components described above in association with the heating element 505 of the intake vent 500.

The blade heating control system 584 and/or the HVAC control system 582 can include computing devices, such as server computers or desktop computers, configured with various hardware and software modules to implement the processes described herein. The computing devices generally include a processor and a computer-readable storage medium or memory storing instructions that, when executed by the processor, allow the computing device to perform its intended functions. The memory generally includes RAM, ROM, and/or other persistent or non-transitory memory. In one example, a user (e.g., a datacenter administrator or a HVAC technician) may use a computing device to adjust parameters to alter a manner in which cooling systems function, such as by modifying goal temperatures, triggering events, timing, and/or other characteristics of the cooling system operation. In some embodiments, computing devices can additionally or alternatively operate automatically, without ongoing input from a user. For example, the blade heating control system 584 and/or the HVAC control system 582 may automatically process information from sensors 588 and respond by controlling elements associated with the building 580.

Based on the disclosure and teachings provided herein, a person of ordinary skill in the art will appreciate other ways and/or methods to implement the various embodiments. The specification and drawings are, accordingly, to be regarded in an illustrative rather than a restrictive sense. It will, however, be evident that various modifications and changes may be made thereunto without departing from the broader spirit and scope of the disclosure as set forth in the claims.

Other variations are within the spirit of the present disclosure. Thus, while the disclosed techniques are susceptible to various modifications and alternative constructions, certain illustrated embodiments thereof are shown in the drawings and have been described above in detail. It should be understood, however, that there is no intention to limit the disclosure to the specific form or forms disclosed, but on the contrary, the intention is to cover all modifications, alternative constructions, and equivalents falling within the spirit and scope of the disclosure, as defined in the appended claims.

The use of the terms "a" and "an" and "the" and similar referents in the context of describing the disclosed embodiments (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the disclosure and does not pose a limitation on the scope of the disclosure unless otherwise claimed. No language in the specification should be construed as indicating any non-claimed element as essential to the practice of the disclosure.

Disjunctive language such as the phrase "at least one of X, Y, or Z," unless specifically stated otherwise, is intended to he understood within the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

Preferred embodiments of this disclosure are described herein, including the best mode known to the inventors for carrying out the disclosure. Variations of those preferred embodiments may become apparent to those of ordinary skill in the art upon reading the foregoing description. The inventors expect skilled artisans to employ such variations as appropriate and the inventors intend for the disclosure to be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

All references, including publications, patent applications, and patents, cited herein are hereby incorporated by reference to the same extent as if each reference were individually and specifically indicated to be incorporated by reference and were set forth in its entirety herein.

What is claimed is:

1. A building comprising:

a space or room within the building; and a heating, ventilation, and air conditioning system (HVAC system), the HVAC system configured to provide air of a certain temperature to the space or room, the HVAC system comprising:

an intake vent for drawing air from an environment outside of the building to use in providing the air of the certain temperature to the space or room;

an exhaust vent for releasing air from the space or room into the environment; and a louver assembly in at least one of the intake vent or the exhaust vent, the louver assembly comprising:

a blade having an edge exposed to the environment;

a heating element configured to heat the edge of the blade so as to prevent or eliminate accumulation of ice on the edge of the blade;

a first pivot and a second pivot at opposite ends of the blade, the blade being mounted by the first pivot and the second pivot such that the blade is rotatable about an axis defined by the first pivot and the second pivot;

a linkage attached to the blade at a location between the first pivot and the second pivot such that the blade rotates about the first pivot and the second pivot in response to movement of the linkage; and at least one electrical supply line routed along and in or on the linkage and configured for providing electrical power flow to or from the heating element.

2. The building of claim 1, wherein the heating element comprises a wire positioned along the edge of the blade, the wire configured to produce heat in response to electrical power being supplied to the wire.

3. The building of claim 1, wherein the heating element comprises an infrared heater panel.

4. The building of claim 3, wherein the infrared heater panel is positioned on the blade.

5. The building of claim 1, wherein the building comprises a datacenter and the space or room comprises computer servers cooled by the air of the certain temperature provided to the space or room by the HVAC system.

6. The building of claim 1, wherein the HVAC system further comprises a control system configured to activate the heating element in response to an indication of a presence of conditions associated with a risk, likelihood, or presence of ice accumulation on the blade.

7. A louver assembly comprising:

a frame configured to be installed in a vent opening;

a blade supported by the frame so as to be positioned in the vent opening when the frame is installed in the vent opening;

a first conductive nut supported by the blade;

a second conductive nut supported by the frame, wherein the first conductive nut is adjacent and in contact with the second conductive nut such that the first conductive nut and the second conductive nut are rotatable relative to one another while maintaining an electrical connection for providing electrical power flow through the second conductive nut and the first conductive nut; and a heating element configured to receive power via the first conductive nut and the second conductive nut and heat the blade so as to prevent or eliminate accumulation of ice on the blade.

8. The louver assembly of claim 7, further comprising one or more pivots, the blade being coupled to the frame by the one or more pivots such that the blade is rotatable relative to the frame.

9. The louver assembly of claim 8, further comprising at least one electrical supply line configured for providing electrical power to the heating element via at least one of the one or more pivots.

10. The louver assembly of claim 8, further comprising:

a linkage attached to the blade between a first pivot and a second pivot of the one or more pivots and such that the blade rotates about the one or more pivots in response to movement of the linkage; and at least one electrical supply line routed along the linkage and configured for providing electrical power to the heating element.

11. The louver assembly of claim 7, wherein the blade is coupled to the frame such that the blade remains stationary relative to the frame.

12. The louver assembly of claim 7, further comprising a substrate comprising the heating element, the substrate being coupled with the blade.

13. A blade for a louver assembly, the blade comprising:

a first transverse edge;

a second transverse edge opposite the first transverse edge;

a leading edge extending between the first transverse edge and the second transverse edge;

a trailing edge opposite the leading edge and extending between the first transverse edge and the second transverse edge;

a first arm extending from the first transverse edge;

a second arm extending from the second transverse edge, the blade configured for pivoting about the first arm and the second arm when installed in a frame of the louver assembly;

a first conductive nut at the first arm and supported by the blade, wherein the first conductive nut is configured to be installed adjacent and in contact with a second conductive nut supported by the frame such that the first conductive nut and the second conductive nut are rotatable relative to one another while maintaining an electrical connection for providing electrical power flow through the second conductive nut and the first conductive nut; and a heating element electrically connected with the first arm and the second arm so as to receive electrical power flowing in the first arm via the first conductive nut and the second conductive nut and out the second arm when the blade is installed in the louver assembly, the heating element configured to, as a result of receiving the electrical power, provide heat so as to prevent or eliminate accumulation of ice on at least one of the leading edge or the trailing edge.

14. The blade of claim 13, wherein the heating element comprises:

a first heating element configured to provide heat to the leading edge; and a second heating element configured to provide heat to the trailing edge.

15. The blade of claim 13, wherein the heating element comprises a wire configured to produce heat in response to the electrical power being supplied to the wire.

16. The blade of claim 15, wherein the wire is arranged along the leading edge, at least partially along the first transverse edge, and at least partially along the second transverse edge.

17. The blade of claim 15, wherein the wire is arranged along the trailing edge, at least partially along the first transverse edge, and at least partially along the second transverse edge.

18. The blade of claim 13, wherein the heating element comprises an infrared heater panel.

19. The louver assembly of claim 7, further comprising:

a hood positioned to partially shield the blade from an environment outside the vent opening; and an infrared heater panel positioned on the hood and configured to heat the blade or another blade of the louver assembly so as to prevent or eliminate accumulation of ice thereon.

20. The building of claim 1, further comprising:

a first conductive nut supported by the blade; and a second conductive nut supported by a frame in which the blade is received, wherein the first conductive nut is adjacent and in contact with the second conductive nut such that the first conductive nut and the second conductive nut are rotatable relative to one another while maintaining an electrical connection for providing electrical power flow through the second conductive nut and the first conductive nut and relative to the heating element.

* * * * *